US006900784B2

(12) United States Patent
Tsuchida

(10) Patent No.: US 6,900,784 B2
(45) Date of Patent: May 31, 2005

(54) DISPLAY APPARATUS WITH LUMINANCE ADJUSTMENT FUNCTION

(75) Inventor: Masami Tsuchida, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 92 days.

(21) Appl. No.: 10/200,451

(22) Filed: Jul. 23, 2002

(65) Prior Publication Data

US 2003/0179163 A1 Sep. 25, 2003

(30) Foreign Application Priority Data

Jul. 30, 2001 (JP) ..... 2001-229005

(51) Int. Cl.[7] ..... G09G 3/30

(52) U.S. Cl. ..... 345/76; 345/44; 345/55; 345/82; 313/463; 315/169.3; 348/657

(58) Field of Search ..... 345/76–78, 44, 345/55, 82; 315/169.3; 313/463; 348/657

(56) References Cited

U.S. PATENT DOCUMENTS 5,714,968 A * 2/1998 Ikeda ..... 345/77
6,229,508 B1 * 5/2001 Kane ..... 345/82
6,356,029 B1 3/2002 Hunter
6,583,775 B1 * 6/2003 Sekiya et al. ..... 345/76
6,611,245 B1 * 8/2003 Edwards ..... 345/76
2002/0047550 A1 4/2002 Tanada

FOREIGN PATENT DOCUMENTS

EP 1 005 013 A1 5/2000
EP 1 170 719 A1 1/2002
GB 2 360 870 B1 10/2001

* cited by examiner

*Primary Examiner*—Henry N. Tran
(74) *Attorney, Agent, or Firm*—Sughrue Mion, PLLC

(57) ABSTRACT

A display apparatus is capable of displaying an image at a proper luminance based on an input video signal without being influenced by temperature changes or time-dependent changes. The display apparatus is provided with a monitoring circuit constituted by a monitoring luminescent device, a reference current source of a reference drive current for causing the monitoring luminescent device to emit light at a luminance of K %, a transistor for supplying the reference drive current to the monitoring luminescent device, and a switch for connecting an output end of the reference drive current and a control end of the transistor. An input video signal is corrected to have a level according to the voltage value on the control end of the transistor driving the monitoring luminescent device when the luminance indicated by the video signal is K % of a maximum luminance level.

7 Claims, 7 Drawing Sheets

DISPLAY APPARATUS WITH LUMINANCE ADJUSTMENT FUNCTION

BACKGROUND OF THE INVENTION

1. Field of the Invention

The present invention relates to a display apparatus including mounting an active matrix type display panel.

2. Description of Related Art

Nowadays, an electroluminescent display apparatus (hereinafter referred to as "the EL display apparatus") incorporating a display panel that uses organic electroluminescent devices (hereinafter referred to as "EL devices") as luminescent devices carrying pixels has been attracting attention. A simple matrix drive type and an active matrix drive type are known as the driving scheme for the display panel of the EL display apparatus. The active matrix drive type EL display apparatus is advantageous in that it consumes less power and incurs less cross talk among pixels, as compared with the simple matrix type, making it particularly suitable for a large-screen display or a high-definition display.

FIG. 1 schematically shows the construction of an active matrix drive type EL display apparatus.

The EL display apparatus shown in FIG. 1 is constructed of a display panel 10 and a drive unit 100 for driving the display panel 10 in response to a video signal $V_L$.

The display panel 10 has an anode power bus line 16, a cathode power bus line 17, scanning lines or scanning electrodes $A_1$ through $A_n$ for n horizontal scanning lines of one screen, and m data lines or data electrodes $B_1$ through $B_m$ disposed to cross the scanning lines. A power potential Vc is applied to the anode power bus line 16, while a ground potential GND is applied to the cathode power bus line 17. Furthermore, EL elements $E_{1,1}$ through $E_{n,m}$ carrying the pixels are formed at the intersections of the scanning lines $A_1$ through $A_n$ and the data lines $B_1$ through $B_m$ in the display panel 10.

FIG. 2 shows an example of the internal construction of an EL unit E formed at the intersection of a scanning line A and a data line B.

Referring to FIG. 2, the scanning line A is connected to a gate G of a field effect transistor (FET) 11 for selecting scanning lines, a data line B being connected to a drain D thereof. A gate G of a FET 12 acting as a light emission drive transistor is connected to a source S of the FET 11. The power potential Vc is applied to a source S of the FET 12 via the anode power bus line 16, and a capacitor 13 is connected between the gate G and the source S. Furthermore, an anode end of an EL device 15 is connected to a drain D of the FET 12. The ground potential GND is applied to the cathode end of the EL device 15 via the cathode power bus line 17.

The drive unit 100 selectively applies scanning pulses to the scanning lines $A_1$ through $A_n$ of the display panel 10 in sequence. In synchronization with the application timings of the scanning pulses, the drive unit 100 also generates pixel data pulses $DP_1$ through $DP_m$ on the basis of the video signal $V_L$ corresponding to each of the horizontal scanning lines, and applies the generated pulses to the data lines $B_1$ through $B_m$. Each of the pixel data pulses DP has a pulse voltage based on the luminance level indicated by the video signal $V_L$. Pixel data is written to the EL devices connected to the scanning line A to which a scanning pulse is applied. The FET 11 in the EL unit E to which the pixel data is written turns ON in response to the scanning pulse, and applies the pixel data pulse DP supplied via the data line B to the gate G of the FET 12 and the capacitor 13. The FET 12 produces a light emission drive current based on the pulse voltage of the pixel data pulse DP and applies the produced current to the EL device 15. With the light emission drive current, the EL device 15 emits light at a luminance based on the pulse voltage of the pixel data pulse DP. Meanwhile, the capacitor 13 is charged by the pulse voltage of the pixel data pulse DP. The charging operation maintains the capacitor 13 at the voltage level corresponding to the luminance level indicated by the video signal $V_L$, causing pixel data to be written. When the pixel data has been written, the FET 11 turns OFF to stop the supply of the pixel data pulse DP to the gate G of the FET 12. However, the voltage held at the capacitor 13 mentioned above continues to be applied to the gate G of the FET 12, so that the FET 12 continues to supply the light emission drive current to the EL device 15. This means that, even after the writing of the pixel data has been completed, the EL device 15 continues to emit light at a luminance based on the luminance level indicated by the video signal $V_L$.

On the other hand, the characteristics of the FET 11, the FET 12, and the EL device 15 vary according to temperature or with time. This has been posing a problem in that, if, for example, an ambient temperature changes, then the light emission drive current passing through the EL device 15 does not reach a desired current value, so that the EL device 15 cannot emit light at a proper luminance based on a received video signal.

SUMMARY OF THE INVENTION

The present invention has been made in veiw of the problem described above, and it is an object of the invention to provide a display apparatus capable of display images at proper luminances based on a received video signal independently of changes in temperature or time.

To this end, according to the present invention, there is provided a display apparatus incorporating a display panel constituted by luminescent pixel units arranged in a matrix pattern, each of the luminescent pixel units including a first transistor for generating a drive current based on a video signal, and a luminescent device that emits light at a luminance based on the drive current, the display apparatus having a monitoring luminescent device, a reference current source generating a reference drive current that causes the monitoring luminescent device to emit light at a luminance of K % of a maximum luminance level, a second transistor for supplying the reference drive current to the monitoring luminescent device, a switch for connecting an output end of the reference drive current in the second transistor and a control end of the second transistor, and a video signal corrector for correcting the video signal so that a voltage value on a control end of said first transistor is equal to the voltage value on the control end of the second transistor when the luminance indicated by the video signal is K % of the maximum luminance level.

DESCRIPTION OF THE PREFERRED EMBODIMENTS

The embodiments of the present invention will be explained in detail with reference to the accompanying drawings.

Figure 3:
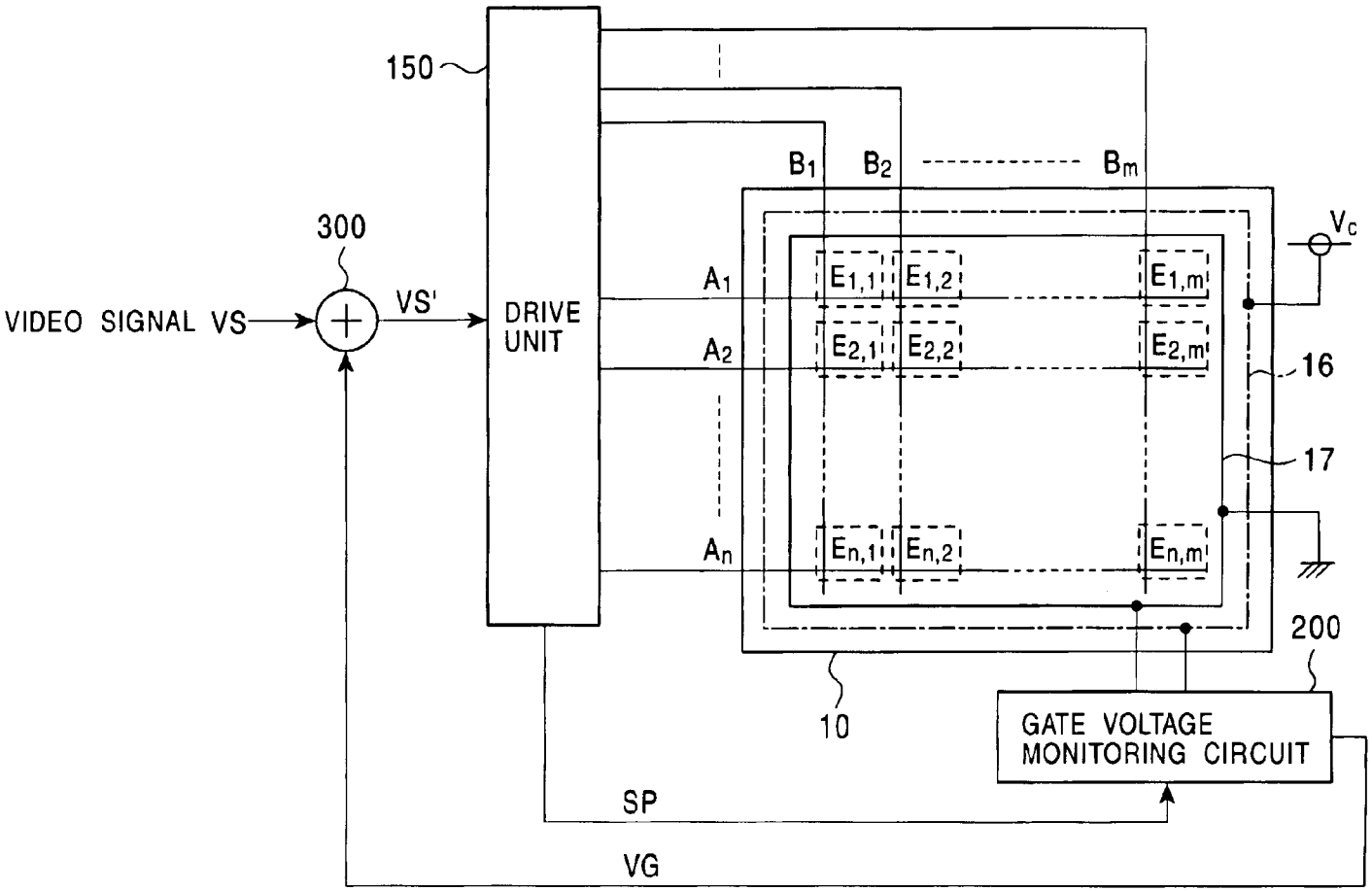
FIG. 3 shows the construction of the active matrix drive type EL display apparatus in accordance with the present invention.

FIG. 3 shows the construction of the active matrix drive type EL display apparatus in accordance with the present invention.

Referring to FIG. 3, the EL display apparatus in accordance with the present invention is constructed of a display panel 10, a drive unit 150 for driving the display panel 10, a gate voltage monitoring circuit 200, and an adder 300.

The display panel 10 has an anode power bus line 16, a cathode power bus line 17, scanning lines $A_1$ through $A_n$ for n horizontal scanning lines of one screen, and m data lines $B_1$ through $B_m$ disposed such that they cross the scanning lines. A power potential Vc is applied to the anode power bus line 16, while a ground potential GND is applied to the cathode power bus line 17. Furthermore, EL devices $E_{1,1}$ through $E_{n,m}$ carrying the pixels are formed at the intersections of the scanning lines $A_1$ through $A_n$ and the data lines $B_1$ through $B_m$ in the display panel 10. The internal construction of the EL unit E is the same as that shown in FIG. 2 described above, so that the explanation thereof will be omitted.

The gate voltage monitoring circuit 200 is formed in the vicinity of the display panel 10.

Figure 4:
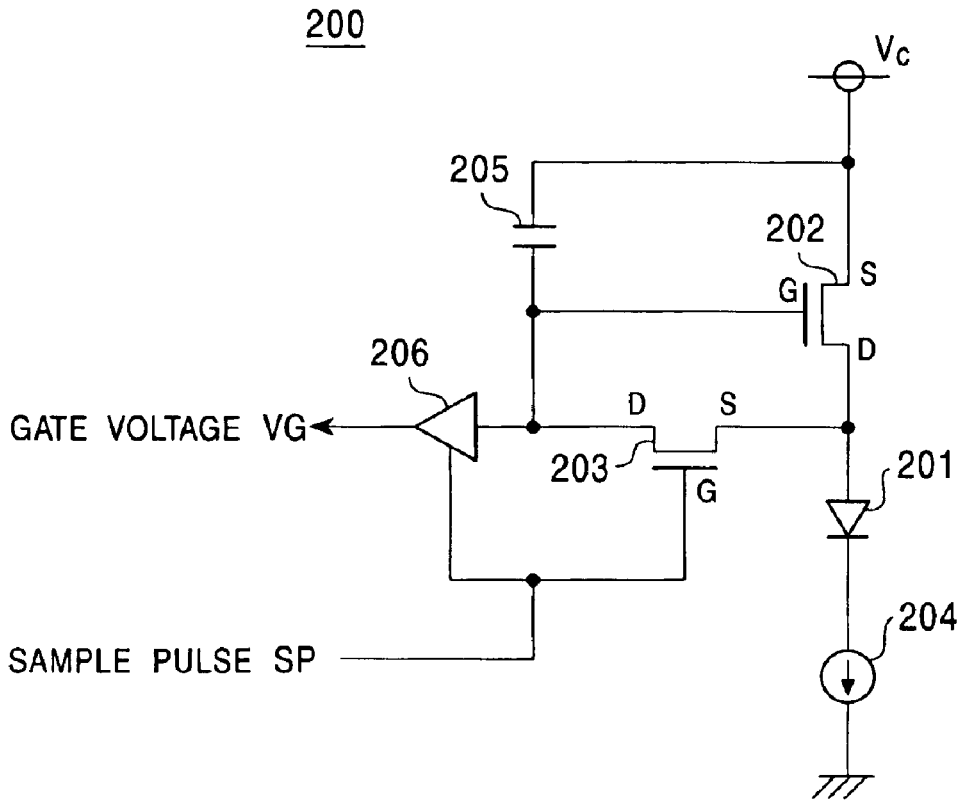
FIG. 4 shows the configuration of a gate voltage monitoring circuit 200.

FIG. 4 shows the configuration of the gate voltage monitoring circuit 200.

Referring to FIG. 4, a drain D of a field effect transistor (FET) 202 and a source S of a FET 203 are connected to one end of the monitoring EL device 201, while a reference current source 204 is connected to the other end thereof. The reference current source 204 generates a predetermined reference current $I_{REF}$ to be passed through the EL device 201. The reference current $I_{REF}$ is 50% of a current amount that is supplied to cause the EL device 201 to emit light at a maximum luminance level. This means that, when the reference current $I_{REF}$ is supplied, the EL device 201 emits light at a luminance of 50% of its maximum luminance level. A power potential Vc is applied to the source S of the FET 202 via the anode power bus line 16, and a capacitor 205 is connected between a gate G and a source S. The FET 203 acts as a "switch" and turns ON when a sample pulse SP is supplied to the gate G thereof. A sample holding circuit 206 is provided so that it captures and stores the voltage at the gate G of the FET 202 at the time when the sample pulse SP is supplied to the FET 203, and outputs the voltage as a gate voltage VG.

More specifically, when the sample pulse SP is supplied, the the sampling process takes place as follows. Since the FET 203 is switched ON when the sample pulse SP is supplied, electrical connection is made between the gate G and the source S of the FET 202. In this state, the reference current $I_{REF}$ is allowed to flow through the FET 202 and the EL device 201. The gate voltge VG of the FET 202 is derived according to the relationship between the drain current Id and the gate-source voltage Vgs, generally depicted by a Vgs–Id characteristics curve (in this case Vgs=VG, Id=$I_{REF}$). When the FET 203 turns OFF after having turned ON, the voltage VG at the gate of the FET 202 is held by the capacitor 205. The sampling process described above is however repeatedly performed in order to accurately measure the gate voltage VG which may be affected by various factors, such as ambient temperature.

An adder 300 adds the gate voltage VG to a received video signal VS and supplies the result as a video signal VS' to a drive unit 150. At this time, the value indicating a maximum luminance level in the video signal VS is denoted as VM, and the value indicating a minimum luminance level is denoted as −VM.

The drive unit 150 selectively applies scanning pulses to the scanning lines $A_1$ through $A_n$ of the display panel 10 in sequence. Furthermore, the drive unit 150 generates pixel data pulses $DP_1$ through $DP_m$ based on the video signal VS' corresponding to horizontal scanning lines in synchronization with the timings at which the scanning pulses are applied, and applies the generated pixel data pulses to data lines $B_1$ through $B_m$. Each of the pixel data pulses DP has a pulse voltage based on the luminance level indicated by the video signal VS'. Pixel data is written to the EL devices connected to the scanning line A to which a scanning pulse is applied. The FET 11 in the EL unit E to which the pixel data is written turns ON in response to the scanning pulse, and applies the pixel data pulse DP supplied via the data line B to the gate G of the FET 12 and the capacitor 13. The FET 12 produces a light emission drive current based on the pulse voltage of the pixel data pulse DP and applies the produced current to the EL device 15. With the light emission drive current, the EL device 15 emits light at a luminance based on the pulse voltage of the pixel data pulse DP. Meanwhile, the capacitor 13 is charged by the pulse voltage of the pixel data pulse DP. The charging operation maintains the capacitor 13 at the voltage level corresponding to the luminance level indicated by the video signal VS', causing pixel data to be written. When the pixel data has been written, the FET 11 turns OFF and the supply of the pixel data pulse DP to the gate G of the FET 12 is stopped. However, the voltage held at the capacitor 13 mentioned above continues to be applied to the gate G of the FET 12, so that the FET 12 continues to supply the light emission drive current to the EL device 15. This means that, even after the writing of the pixel data has been completed, the EL device 15 continues to emit light at a luminance based on the luminance level indicated by the video signal VS'. Thus, an image is displayed on the screen of the display panel 10 on the basis of the received video signal VS.

The drive unit 150 drives the display panel 10 as described above, and also supplies the sample pulses SP to the gate voltage monitoring circuit 200 at predetermined intervals to correct changes in the luminance of the display panel 10 caused by a temperature change or time-dependent change.

The descriptions will now be given of the luminance correcting operation performed by the gate voltage monitoring circuit 200 and the adder 300 in response to the sample pulses SP.

First, when the sample pulse SP is supplied to the gate voltage monitoring circuit 200, the FET 203 turns ON, and the reference current $I_{REF}$ for causing the EL device 201 to emit light at the 50% luminance passes between the source S and the drain D of the FET 202. Then, the gate voltage for passing the reference current $I_{REF}$ between the source S and the drain D of the FET 202 is generated at the gate G of the FET 202. In other words, the gate voltage for causing the EL device 201 to emit light at the 50% luminance is applied to the gate G of the FET 202. The sample holding circuit 206 captures and stores the gate voltage of the FET 202 in response to the sample pulse SP, and supplies the gate voltage as the gate voltage VG to the adder 300.

The constructions of the EL device 201, the FET 202, and the capacitor 205 provided in the gate voltage monitoring circuit 200 are identical to those of the EL device 15, the FET 12, and the capacitor 13 formed in each EL unit E. Thus, the voltage to be applied to the gate G of the FET 12 to cause the EL device 15 to emit light at the 50% luminance at a current temperature is measured as the gate voltage VG by the gate voltage monitoring circuit 200.

The adder 300 adds the gate voltage VG to the video signal VS so as to produce a video signal VS' obtained by making a correction to compensate for the change in the luminance of the display panel 10 caused by a temperature change or time-dependent change.

The video signal VS indicates the minimum to maximum luminance levels within the range from −VM to VM, as mentioned above. Hence, the video signal VS' determined by adding the gate voltage VG to the video signal VS takes the values within the range defined below:

$$[-VM+VG] \leqq VS' \leqq [VM+VG]$$

The intermediate value of the above range is obtained by:

$$\{[VM+VG]+[-VM+VG]\}/2=VG$$

Thus, the video signal VS' is the signal that has been corrected so that the central value of the range of luminance levels is always equal to the value of the voltage to be applied to the gate G of the FET 12 to cause the EL device 15 to emit light at the 50% luminance. In other words, to cause the EL device 15 to emit light at the 50% luminance, the video signal VS is corrected on the basis of the gate voltage VG to be applied to the gate G of the FET 12 so as to obtain the video signal VS'.

Therefore, driving the display panel 10 according to the video signal VS' makes it possible to obtain a display image having a proper luminance level, accommodating changes in ambient temperature and time-dependent changes.

In the above embodiment, the value of the gate voltage to be applied to the gate G, which is the control end of the FET 12, to cause the EL device 15 to emit light at the 50% luminance is used as the reference. However, the reference does not have to be the gate voltage obtained for the light emission at 50% luminance.

In short, other gate voltages may be used as the reference as long as a gate voltage $VG_K$ to be applied to the control end (gate G) of the FET 12 is measured, and the input video signal is corrected so that the value of K % of the maximum luminance level indicated by a video signal is equal to the gate voltage $VG_K$ when causing the EL device 15 to emit light at the K % luminance.

Alternatively, a gate voltage $VG_L$ to be applied to the gate G of the FET 12 to cause the EL device 15 to emit light at a luminance of, for example, 10%, at a current temperature, and a gate voltage $VG_H$ to be applied to cause the EL device 15 to emit light at a luminance of 90% may be measured, and an input video signal may be corrected on the basis of these gate voltages $VG_L$ and $VG_H$.

Figure 5:
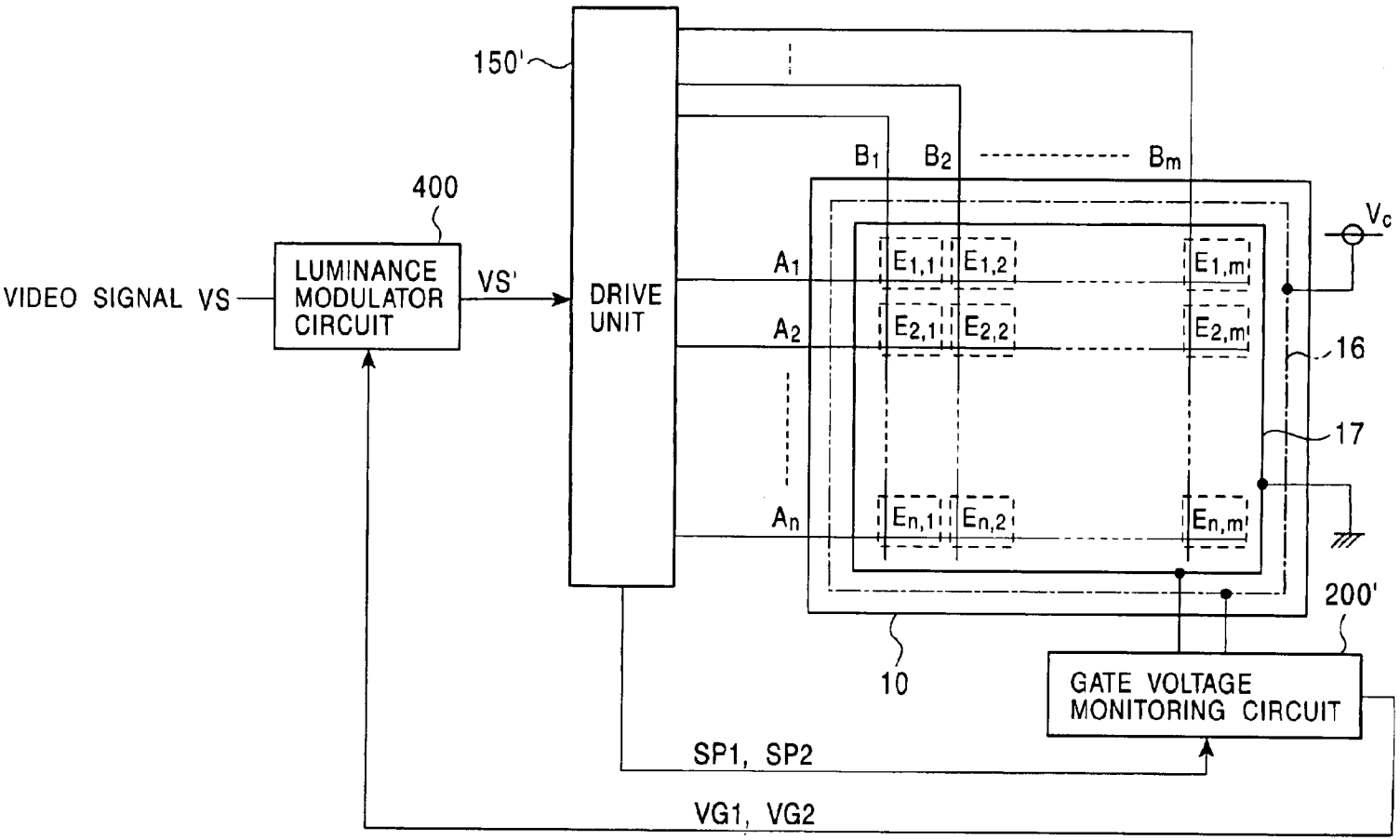
FIG. 5 shows the construction of another embodiment of the EL display apparatus according to the present invention.

FIG. 5 shows the construction of an EL display apparatus according to another embodiment of the present invention made in view of the above.

The display panel 10 shown in FIG. 5 has the same construction as those shown in FIG. 3 and FIG. 4, and the driving operation of the display panel 10 performed by a drive unit 150' is also the same as that by the drive unit 150 shown in FIG. 3; hence, the explanation thereof will be omitted.

Referring to FIG. 5, while driving the display panel 10 described above, the drive unit 150' supplies sample pulses SP1 and SP2 in sequence to a gate voltage monitoring circuit 200' as necessary to compensate for a change in the luminance of the display panel 10 caused by a temperature change and a time-dependent change.

Figure 6:
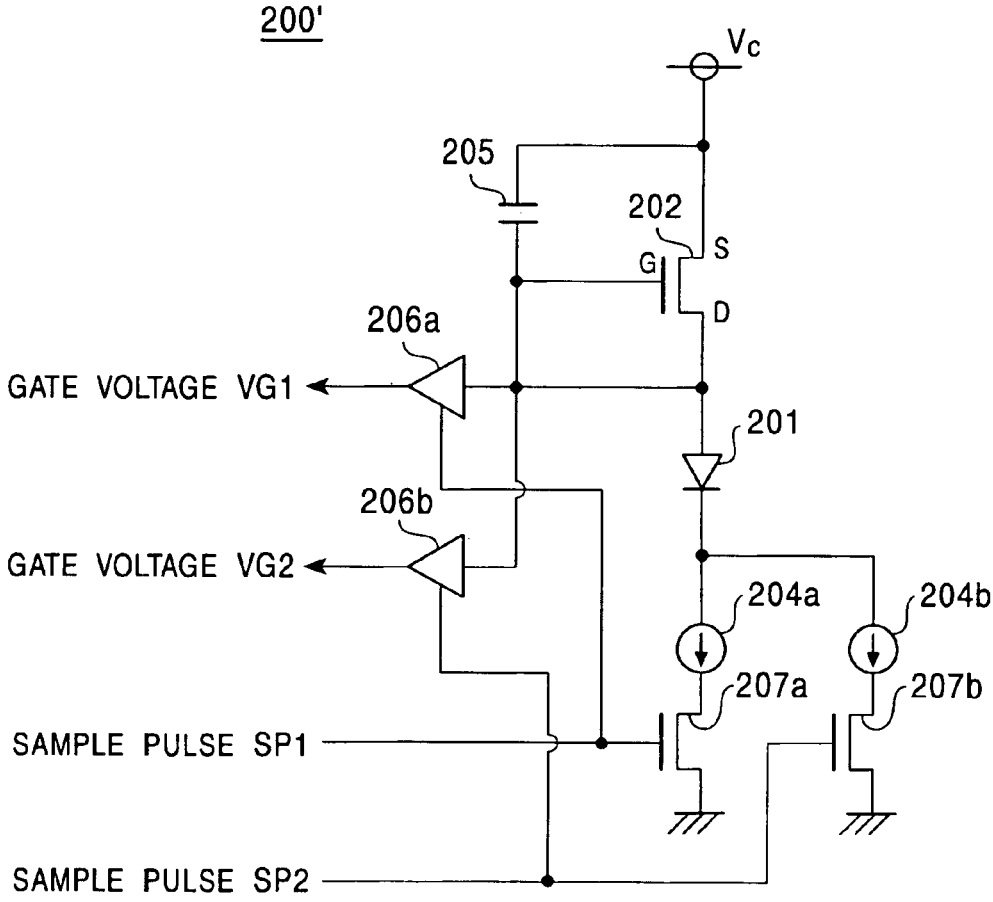
FIG. 6 shows the configuration of a gate voltage monitoring circuit 200' provided in the EL display apparatus shown in FIG. 5.

FIG. 6 shows the configuration of the gate voltage monitoring circuit 200'.

Referring to FIG. 6, a drain D of a FET 202 is connected to one end of a monitoring EL device 201, and reference current sources 204*a* and 204*b* are connected to the other end thereof. The reference current source 204*a* generates a reference current $IL_{REF}$ for causing the EL device 201 to emit light at 10% of its maximum luminance level. The reference current source 204*b* generates a reference current $IH_{REF}$ for causing the EL device 201 to emit light at 90% of its maximum luminance level. An FET 207*a* turns ON in response to the sample pulse SP1 supplied from the drive unit 150' to pass the reference current $IL_{REF}$ produced by the reference current source 204*a* to the EL device 201. A FET 207*b* turns ON in response to the sample pulse SP2 supplied from the drive unit 150' to pass the reference current $IH_{REF}$ produced by the reference current source 204*b* to the EL device 201. A power potential Vc is applied to a source S of the FET 202 via an anode power bus line 16, and a capacitor 205 is connected between a gate G and the source S. A sample holding circuit 206*a* captures and stores the voltage of the gate G of the FET 202 in response to the sample pulse SP1 supplied, and outputs the voltage as a gate voltage VG1. A sample holding circuit 206*b* captures and stores the voltage at the gate G of the FET 202 in response to the sample pulse SP2 supplied, and outputs the voltage as a gate voltage VG2.

A luminance modulator circuit 400 modulates the video signal VS to produce a video signal VS' so that its level when the luminance represented by a video signal VS' is 10% of the maximum luminance level is equal to or corresponds to the gate voltage VG1 and its level when the luminance represented by the video signal VS' is 90% of the maximum luminance level is equal to or corresponds the gate voltage VG2.

Essential point is that the voltage level of the pixel data pulse DP supplied through the data line B (each of pixel data pulse $DP_1$–$DP_m$ supplied through the data lines $B_1$–$B_m$ shown in FIG. 5) becomes equal to VG1 when the luminance represented by a video signal VS' is 10% of the maximum luminance level, and becomes equal to VG2 when the luminance represented by the video signal VS' is 90% of the maximum luminance level.

In the above embodiment, the gate voltage monitoring circuit 200 is formed outside the display panel 10. Alternatively, however, the function of the gate voltage monitoring circuit 200 may be incorporated in one of the EL devices formed in the display panel 10. In this case, it is possible to selectively perform a normal display operation or the gate voltage monitoring operation described above by providing a selector switch in the EL device.

Figure 7:
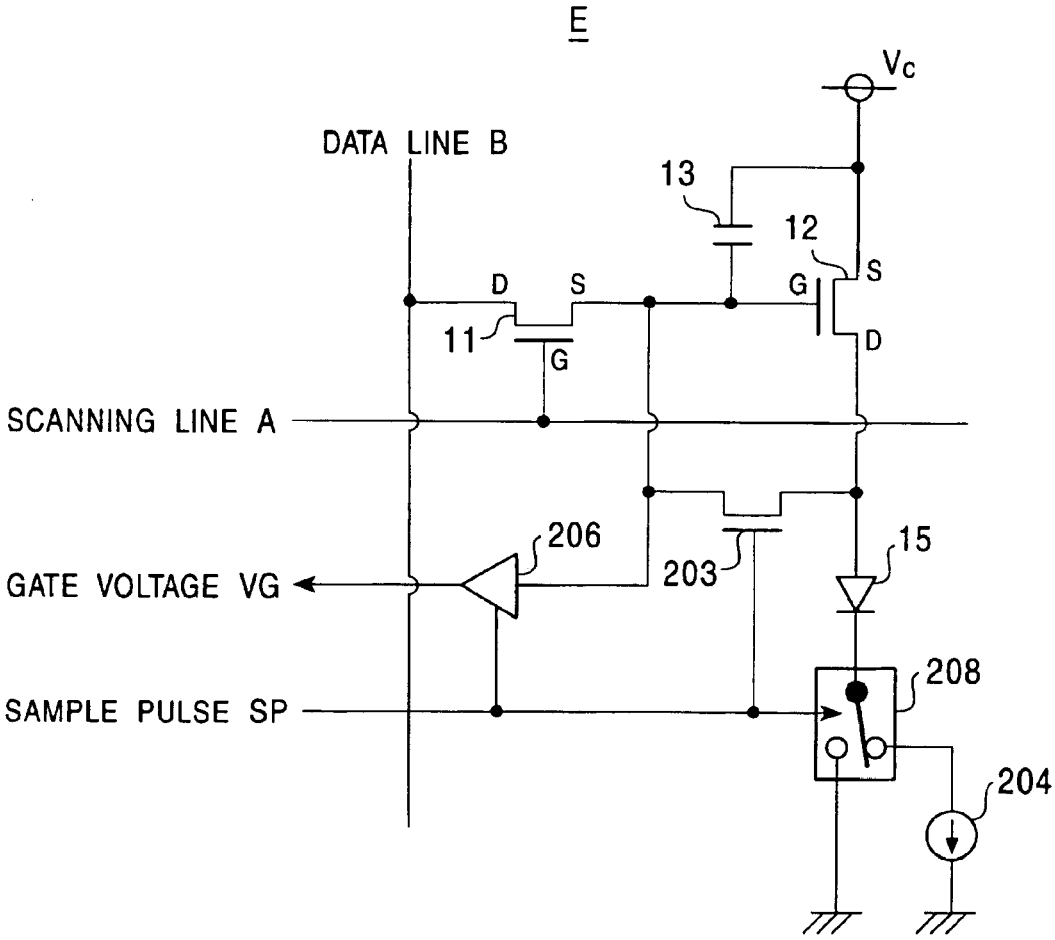
FIG. 7 shows an example of the internal construction of an EL unit E equipped with the functions of the gate voltage monitoring circuit 200.

FIG. 7 shows an example of the internal construction of the EL unit E incorporating the function of the gate voltage monitoring circuit 200.

Figure 1:
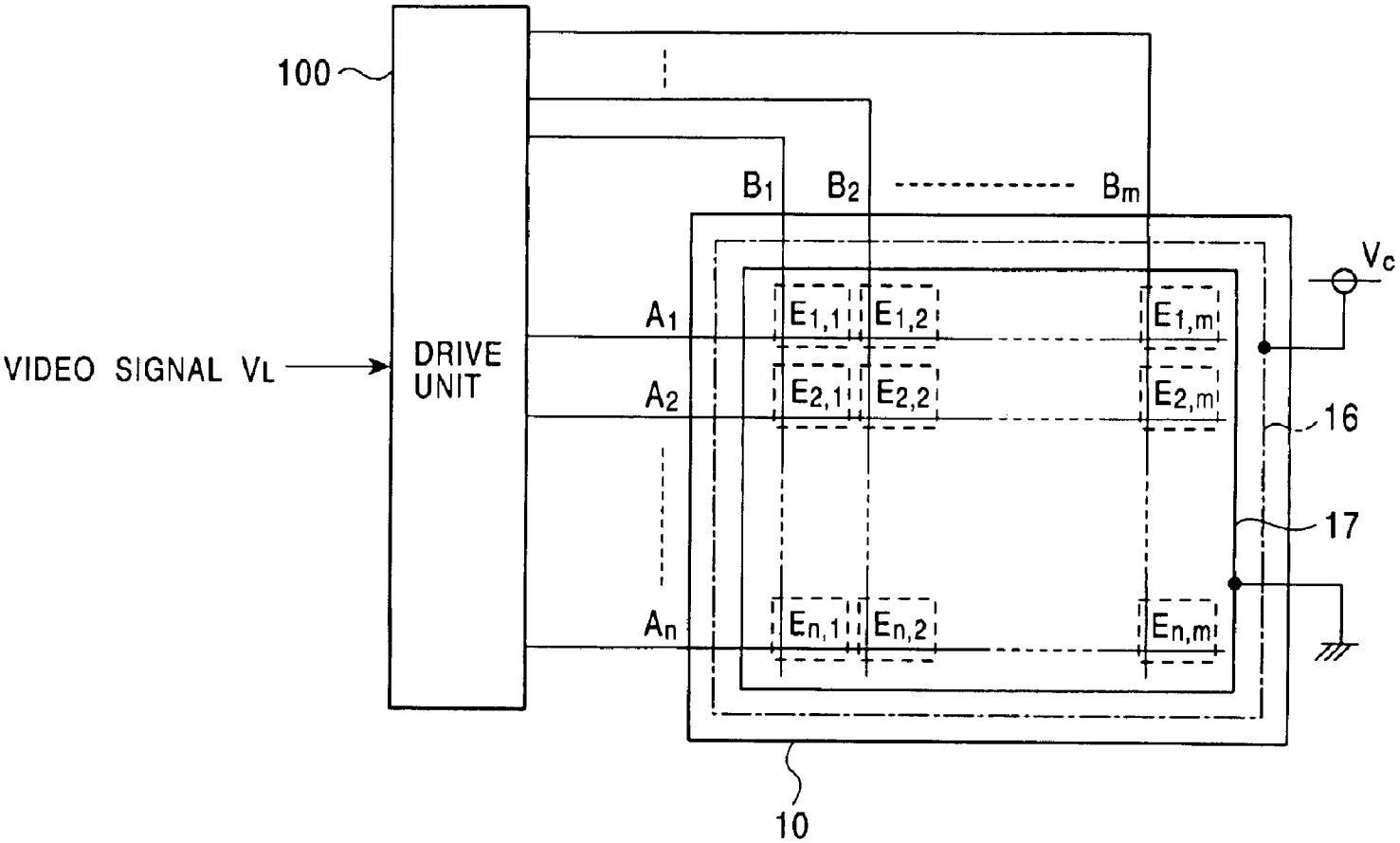
FIG. 1 is a shematic diagram of an active matrix drive type EL display apparatus.
Figure 2:
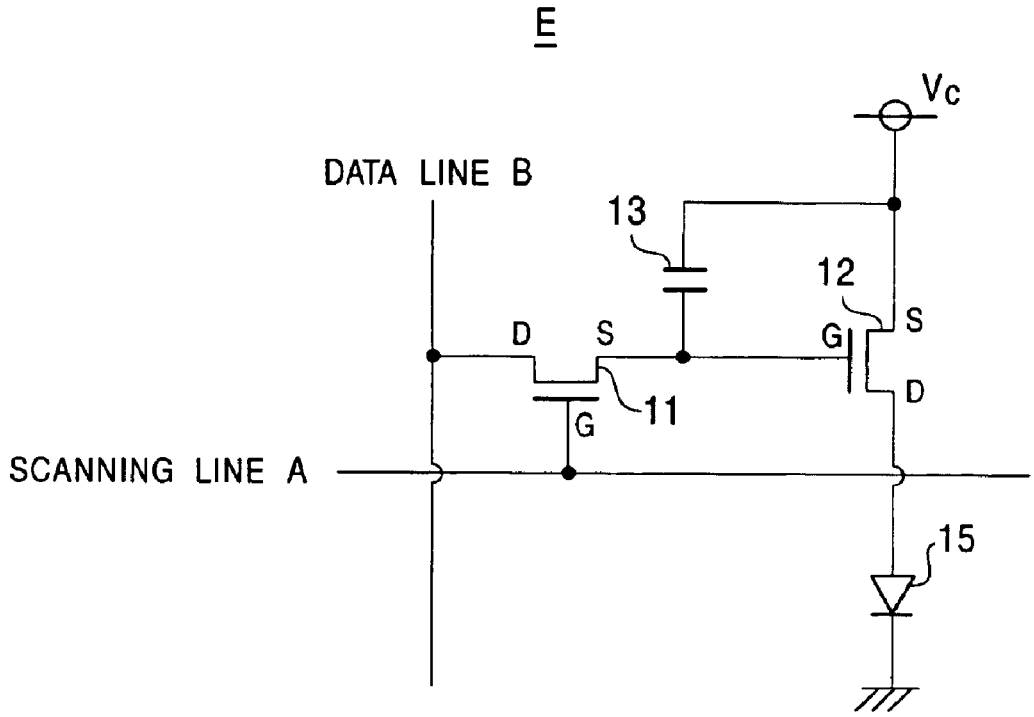
FIG. 2 shows an example of an internal construction of an EL unit E carrying pixels.

Referring to FIG. 7, a FET 11, a FET 12, a capacitor 13, and an EL device 15 have the same constructions as those of the module making up the EL unit E shown in FIG. 2. An FET 203, a reference current source 204, and a sample holding circuit 206 shown in FIG. 7 have the same constructions as those of the module making up the gate voltage monitoring circuit 200 shown in FIG. 4.

The EL unit E shown in FIG. 7 is provided with a switch 208 for selectively carrying out the basic operation of the EL unit E or the operation as the gate voltage monitoring circuit 200. The switch 208 is set either to a mode in which a ground potential GND is applied to a cathode end of the EL device 15 or to a mode in which the reference current source 204 is connected to the cathode end of the EL device 15. This means that the switch 208 is set to the mode in which the ground potential GND is applied to the cathode end of the EL device 15 while no sample pulse SP is being supplied from a drive unit 150. At this time, none of the FET 203, the reference current source 204, and the sample holding circuit 206 operate, so that the EL unit E shown in FIG. 7 performs its basic operation, as mentioned above.

While the sample pulse SP is being supplied from the drive unit 150, the switch 208 is set to the mode in which the reference current source 204 is connected to the cathode end of the EL device 15. Furthermore, the supply of the sample pulse SP causes the FET 203 to turn ON, and the reference current $I_{REF}$ for causing the EL device 15 to emit light at the 50% luminance to pass between the source S and the drain D of the FET 12. The gate voltage for passing the reference current $I_{REF}$ between the source S and the drain D of the FET 12 appears at the gate G of the FET 12. In other words, the gate voltage for causing the EL device 15 to emit light at the 50% luminance is applied to the gate G of the FET 12. A sample holding circuit 206 captures and stores the gate voltage of the FET 12 in response to the sample pulse SP, and outputs the captured and stored gate voltage as the gate voltage VG.

Thus, the EL unit E shown in FIG. 7 carries out the operation as the gate voltage monitoring circuit 200 as mentioned above in response to the supply of the sample pulse SP.

As described above, the display apparatus in accordance with the present invention is provided with the monitoring circuit constituted by a monitoring luminescent device, a reference current source for generating a reference drive current for causing the monitoring luminescent device to emit light at a luminance of K % of a maximum luminance level, a transistor for supplying the reference drive current to the monitoring luminescent device, and a switch for connecting the output end of the reference drive current and the control end of the transistor. An input video signal is corrected so that it has a level according to the voltage value on the control end of the monitoring luminescent device driving transistor when the luminance represented by the video signal is K % of the maximum luminance level.

Thus, according to the present invention, an image can be displayed at a proper luminance based on a received video signal, independently of a temperature change or a time-dependent change.

This application is based on Japanese Patent Application No. 2001-229005 which is herein incorporated by reference.

What is claimed is:

1. A display apparatus comprising:

a display panel constituted by luminescent pixel units arranged in a matrix pattern, each of said luminescent pixel units including a first transistor for generating a drive current based on a video signal and a luminescent device that emits light at a luminance based on the drive current;

a monitoring luminescent device provided additionally to said luminescent devices of said luminescent pixel units;

a reference current source, connected in series with said monitoring luminescent devices, generating a reference drive current that causes the monitoring luminescent device to emit light at a luminance of K % of a maximum luminance level;

a second transistor, connected in series with said monitoring luminescent device, for supplying the reference drive current to the monitoring luminescent device;

a switch having a closed state for connecting a reference drive current output end of the second transistor and a control end of the second transistor; and a video signal corrector, responsive to a voltage at said control end of the second transistor when said switch is at said closed state, for correcting the video signal so that a voltage value on a control end of said first transistor is equal to the voltage value on the control end of the second transistor when a luminance indicated by the video signal is K % of the maximum luminance level.

2. The display apparatus according to claim 1, wherein the video signal corrector is an adder that adds the voltage value on the control end of the second transistor to the video signal.

3. The display apparatus according to claim 1, wherein the switch is turned ON at predetermined intervals to connect the output end of said second transistor to output the reference drive current and the control end of said second transistor.

4. The display apparatus according to claim 1, further comprising means for capturing and retaining a voltage value on the control end of the second transistor at predetermined intervals, and supplying the voltage value to the video signal corrector.

5. The display apparatus according to claim 1, wherein the luminescent device is an electroluminescent device.

6. A display apparatus comprising:

a display panel constituted by luminescent pixel units arranged in a matrix pattern, each of said luminescent pixel units including a first transistor for generating a drive current based on a video signal and a luminescent device that emits light at a luminance based on the drive current;

a monitoring luminescent device provided separately from said luminescent device in each of said luminescent pixel units;

a reference current source, connected in series with said monitoring luminescent device, generating a reference drive current that causes the monitoring luminescent device to emit light at a luminance of K % of a maximum luminance level;

a second transistor, connected in series with said monitoring luminescent device, for supplying the reference drive current to the monitoring luminescent device;

a switch having a closed state, connecting in series with said reference current source; and a video signal corrector, responsive to a voltage at said control end of the second transistor when said switch is at said closed state, for correcting the video signal so that a voltage value on a control end of said first transistor is equal to the voltage value on the control end of the second transistor when a luminance indicated by the video signal is K % of the maximum luminance level.

7. A display apparatus comprising:

a display panel constituted by luminescent pixel units arranged in a matrix pattern, each of said luminescent pixel units including a first transistor for generating a drive current based on a video signal and a luminescent device that emits light at a luminance based on the drive current;

a monitoring luminescent device selected from among said luminescent device included in said luminescent pixel units;

a reference current source, connected in series with said monitoring luminescent device, generating a reference drive current that causes the monitoring luminescent device to emit light at a luminance of K % of a maximum luminance level;

a second transistor, selected from among said first transistors, which is connected in series with said monitoring luminescent device, for supplying the reference drive current to the monitoring luminescent device;

a switch having a closed state for connecting a reference drive current output end of said second transistor and a control end of the second transistor; and a video signal corrector, responsive to a voltage at said control end of the second transistor when said switch is at said closed state, for correcting the video signal so that a voltage value on a control end of said first transistor is equal to the voltage value on the control end of the second transistor when a luminance indicated by the video signal is K % of the maximum luminance level.

* * * * *